US008198755B2

(12) United States Patent
Seefried et al.

(10) Patent No.: US 8,198,755 B2
(45) Date of Patent: Jun. 12, 2012

(54) CONTACTLESS ENERGY AND DATA TRANSMISSION DEVICE AND METHOD

(75) Inventors: Roland Seefried, Heidelberg (DE); Dennis Trebbels, Kirrweiler (DE)

(73) Assignee: Pepperl + Fuchs GmbH, Mannheim (DE)

( * ) Notice: Subject to any disclaimer, the term of this patent is extended or adjusted under 35 U.S.C. 154(b) by 612 days.

(21) Appl. No.: 12/359,495

(22) Filed: Jan. 26, 2009

(65) Prior Publication Data

US 2009/0189459 A1 Jul. 30, 2009

(30) Foreign Application Priority Data

Jan. 25, 2008 (EP) ..... 08001422

(51) Int. Cl.
*H01F 27/42* (2006.01)
*H01F 37/00* (2006.01)
*H01F 38/00* (2006.01)

(52) U.S. Cl. ..... 307/104; 320/108

(58) Field of Classification Search ..... None
See application file for complete search history.

(56) References Cited

U.S. PATENT DOCUMENTS

| | | | | |
|---|---|---|---|---|
| 4,757,213 | A * | 7/1988 | Tigges et al. | 307/116 |
| 5,293,400 | A * | 3/1994 | Monod et al. | 375/219 |
| 5,345,231 | A | 9/1994 | Koo et al. | |
| 5,515,399 | A | 5/1996 | Swart | |
| 5,548,282 | A | 8/1996 | Escritt et al. | |
| 5,706,183 | A * | 1/1998 | Abe et al. | 363/18 |
| 5,896,278 | A * | 4/1999 | Tamura et al. | 363/20 |
| 6,091,779 | A * | 7/2000 | Griessbach | 375/258 |
| 6,501,361 | B1 * | 12/2002 | Michaels et al. | 336/182 |

(Continued)

FOREIGN PATENT DOCUMENTS

| | | | |
|---|---|---|---|
| DE | 41 30 903 | A1 | 3/1993 |
| DE | 44 21 526 | C1 | 8/1995 |
| DE | 100 12 981 | A1 | 9/2001 |
| DE | 102 00 488 | A1 | 7/2003 |
| DE | 10 2004 015 771 | A1 | 10/2005 |
| WO | 2007034421 | A2 | 3/2007 |

OTHER PUBLICATIONS

European Search Report, Application No. EP 08 00 1422, Dated Jun. 25, 2008.

*Primary Examiner* — Rexford Barnie
*Assistant Examiner* — Justen Fauth
(74) *Attorney, Agent, or Firm* — John A. Merecki; Hoffman Warnick LLC

(57) ABSTRACT

The present invention relates to a device for the contactless energy and data transmission, having a primary unit provided with a primary inductor, and a secondary unit provided with a secondary inductor. The primary and secondary units are at least temporarily so relatively positioned that between the primary inductor and the secondary inductor a transformer coupling distance is formed. Furthermore, the primary unit is set up for the contactless transmission of energy to the secondary unit and the secondary unit is designed for supplying terminals connected thereto. The device is further developed in that the primary unit has means for interrupting the energy transmission across the transformer coupling distance in energy transmission intervals and the secondary unit has means for detecting the energy transmission intervals. Further, the secondary unit has means for transmitting data in the energy transmission intervals and/or the primary unit has means for transmitting data to the secondary unit. The invention also relates to a method for the contactless energy and data transmission.

17 Claims, 3 Drawing Sheets

U.S. PATENT DOCUMENTS 6,721,540 B1 * 4/2004 Hayakawa ..... 455/41.1
7,405,540 B2 * 7/2008 Lafontaine ..... 320/166
7,525,449 B1 * 4/2009 Lafontaine ..... 340/984
7,672,759 B1 * 3/2010 Lafontaine ..... 701/21
2010/0066176 A1 * 3/2010 Azancot et al. ..... 307/104
2010/0270867 A1 * 10/2010 Abe ..... 307/104

* cited by examiner

CONTACTLESS ENERGY AND DATA TRANSMISSION DEVICE AND METHOD

FIELD OF THE INVENTION

The present invention is directed to a device for energy and data transmission, and to a method for contactless energy and data transmission between a primary and secondary unit.

RELATED ART

Such devices have a primary unit with a primary inductor and a secondary unit with a secondary inductor. The secondary unit is set up for the connection, supplying and/or controlling of at least one terminal device. Moreover, the primary and secondary units are at least temporarily so positioned relative to one another that a transformer coupling distance is formed between the primary inductor and the secondary inductor. The primary unit is set up for contactless transmission of energy to the secondary unit across the transformer coupling distance and the secondary unit is provided for supplying terminal equipment by means of the energy received across the transformer coupling distance.

Such devices are used if it is necessary to supply and control sensors located on movable, e.g., rotary objects and can consequently not be supplied and polled by means of a cable connection. Examples for this are constituted by sensors on pressure rollers or on movable elements in a high-bay facility.

Conventionally such sensors are, e.g., supplied with information via a radio link. Similar inductive couplings are also used for energy transmission. The primary and secondary unit can be looked upon as parts of the sensor, but also as a separate device which is competent for contactless energy and data transmission. In the simplest case two separate channels are provided for the transmission of energy and the transmission of data. Such device are, e.g., known from DE 100 12 981 A1 or DE 102 00 488 B4.

From other constructions it is known to provide only one interface, which is used for both energy and data transmission.

In the case, e.g., the data are modulated onto the energy transmission and subsequently evaluated in the sensor or the secondary unit. However, it is problematical in this connection to transmit information from the sensor back to the energy supply or the primary unit, so that they can pass on the data to a process control. A sensor with such an energy transmission frequency modulation is, e.g., described in DE 10 2004 015 771 B4. Similar energy and data transmissions are also known in other contactless systems, such as, e.g., for access control from DE 44 21 526 C1.

In order to be able to also transmit information from the sensor back to the energy supply, e.g., DE 41 30 903 A1 describes a device with load modulation. The load is then modified in the sensor and this is detected by the energy supply. As a result of the load variation, information can be transmitted back from the sensor to the primary unit. However, it is disadvantageous in such devices that more energy must be transmitted to the secondary unit than is actually required there in order to carry out a load modulation. It is also often necessary to provide cooling in order to dissipate heat produced by the additional energy consumption.

SUMMARY OF THE INVENTION

The invention provides a contactless energy and data transmission device permitting an efficient energy transmission, but still allowing a simple implementation of the secondary unit. In addition, a method is provided enabling energy and data to be transmitted in contactless manner.

In a first aspect of the invention there is provided a contactless energy and data transmission devices having the features of claim 1.

In a further aspect of the invention there is provided a contactless energy and data transmission method according to claim 8.

Further advantageous embodiments are given in the dependent claims, the description, the drawings and the explanations thereof.

According to the invention, the device is further developed in that the primary unit has means for interrupting the energy transmission across the transformer coupling distance in energy transmission intervals and that the secondary unit has means for detecting the energy transmission intervals. The secondary unit also has means for transmitting data to the primary unit across the transformer coupling distance in the energy transmission interval.

The invention provides a transformer coupling between the primary inductor and the secondary inductor in place of a radio link between the primary unit and secondary unit. The inventive device may, e.g., be used in large factories or production lines. In this connection numerous devices are used, which communicate with one another by radio, so that the radio bands are largely occupied and problems with regards to signal quality arise with multiple use of the bands. Compared with a transformer transmission, radio transmissions are relatively interference-prone, e.g., as a result of electromagnetic fields which are generated by electrical equipment.

In the sense of the present invention, transformer coupling more particularly means the direct coupling between two inductors, e.g., coils. A clearance of a few centimeters or less between the two coils is bridged. The two coils can be coaxially oriented with respect to one another. The aim with regards to the positioning of the coils with respect to one another is to achieve a particularly high coupling factor between the primary inductor and the secondary inductor. It is ideal to have a coupling factor close to or equal to 1. This can, e.g., be achieved by frontal positioning of the two coils relative to one another. To permit a good coupling, a maximum number of field lines of the magnetic field of the primary coil should pass through the secondary coil. The magnetic field can additionally be strengthened or influenced by ferromagnetic cores in the coils.

According to another aspect of the invention the transmission of data from the secondary unit to the primary unit is performed in energy transmission intervals. As a result of this procedure at the time at which the data are transmitted from the secondary unit to the primary unit, no other information or energy are transmitted across the transformer coupling distance. As a result there can be a simpler data transmission, e.g., with respect to the pulse shape or data coding, because no further interfering signals are transmitted at the same time. As a result the corresponding electronics for transmitting signals in the secondary unit can be made simpler. This is of particular interest because the secondary unit only has to be supplied with energy across the transformer coupling distance and can therefore be designed in energy-saving manner.

In accordance with an embodiment of the invention, the secondary unit detects the energy transmission intervals and transmits data to the primary unit only as a consequence of the detection of an energy transmission interval. This means that data are only transmitted to the primary unit if the latter transmits no energy to the secondary unit, i.e., no further signals are transmitted on the transformer coupling distance.

Through the detection of the energy transmission interval it is ensured that no data are erroneously transmitted when energy is being transmitted across the transformer coupling distance, which in principle can, e.g., take place with a transmission sequence or transmission rights only defined by timing. As a result there is also no need for the synchronization of two timers on the primary unit and the secondary unit.

For transmitting energy from the primary unit across the primary inductor to the secondary inductor across the transformer coupling distance the primary inductor is excited by resonant circuit or itself forms part of the resonant circuit. It may form part of the resonant circuit, because as a result no further components have to be provided on the primary unit. The resonant circuit can, e.g., be a parallel or a serial resonant circuit.

In another variant of the inventive device alternatively or additionally to the means for transmitting data to the primary unit provided in the secondary unit, the primary unit has means for transmitting information to the secondary unit. The transmission can, e.g., take place by varying the length of the energy transmission intervals and/or the length of the energy transmission phases.

If the transmission means are provided in both the primary and secondary units, there can be a bidirectional communication across the same channel as that used for energy transmission. Data transmitted from the primary unit to the secondary unit can, e.g., be instructions with respect to switching processes for actuators connected to the secondary unit, initializing commands or configuration data for the secondary unit or equipment connected thereto, e.g., sensors or actuators. Data transmitted from the secondary unit to the primary unit can relate to switching states or other state variables of the connected terminal equipment.

In principle, it is also possible to transmit data from the primary unit to the secondary unit in the energy transmission intervals. For this purpose a corresponding transmission control can be provided, so that data from the primary unit are not superimposed by data from the secondary unit or vice versa.

For initiating the energy transmission interval it is fundamentally sufficient for the resonant circuit to be no longer supplied with energy, so that it slowly decays. In order to accelerate this decay process, it has proved advantageous to provide corresponding devices. Normally during decay the transmitted energy slowly and continuously decreases. In order to on average permit the transmission of a maximum energy quantity across the transformer coupling distance, it is consequently preferable if on initiating an energy transmission interval as rapidly as possible no further energy is transmitted across the transformer coupling distance, i.e., it is possible with maximum speed to commence the actual energy transmission interval, so that with corresponding speed it is possible to again start with repeated energy transmission. This is achieved by the accelerated reduction of the residual energy in the primary inductor. This reduction can, e.g., be achieved through a transistor section in series with the primary inductor. The additional use of a resistor, which picks up this energy, also has an accelerating effect.

For the detection of the transmitted data in the primary unit, it is advantageous to monitor voltage across the primary inductor. If the voltage increases beyond a predetermined threshold in an energy transmission interval, this is interpreted as a data signal and corresponding information is forwarded to a downstream processing means.

In an embodiment, measurement takes place of a current through the primary inductor. This can, e.g., take place by means of a transformer, which can be a circuit board transformer. The measurement signal supplied by the transformer is proportional to the current intensity in the primary inductor. By means of the current flow through the primary inductor it is, e.g., possible to determine the load which is represented by the secondary unit and the connected terminal equipment. Through a load determination it is possible to regulate the resonant circuit current, so that it is not inadmissibly high in the case of low loads. In this case the resonant circuit excitation can, e.g., be interrupted until the current flow is again in a desired range.

The energy transmission intervals on the secondary unit can in principle be determined in a random manner. However, it is advantageous if the secondary unit has means for measuring a voltage across the secondary inductor. If this voltage drops, it is concluded that an energy transmission interval is commencing, so that the emission of data from the secondary unit towards the primary unit is initiated across the transformer coupling distance.

As the energy transmission is interrupted in the energy transmission intervals, it is advantageous for the secondary unit to have a storage capacity for buffering the energy. As a result the supply of the secondary unit and also the connected terminal devices during an energy transmission interval is ensured. It is preferable in this connection if more energy is transmitted during the energy transmission time across the transformer coupling distance than is consumed by the secondary unit and the connected terminal devices at the energy transmission time. Energy storage can be implemented by a capacitor with an upstream rectifier.

As terminal devices or terminals it is, e.g., possible to connect sensors or actuators. It is also possible to connect other loads, such as light bulbs. Examples of actuators are electrical valves.

The sensors can fundamentally be of any type of sensors for the detection of a measured quantity or alternatively objects or articles. The invention can be used with particular advantage for sensors in the industrial sector, e.g., inductive, capacitive or optical sensors, temperature or pressure sensors, which in each case have a corresponding sensor element.

A sensor element can fundamentally be any element which is suitable for detecting a physical quantity. The sensor element can, e.g., be a coil or a resonant circuit of an inductive proximity switch, a photodetector of an optical sensor, a capacitive probe, a thermocouple, etc.

An inventive contactless energy and data transmission method can be implemented with a primary unit and a secondary unit, which in each case have an inductor. The primary and secondary units are at least temporarily positioned in such way that a transformer coupling distance is formed between the primary inductor and secondary inductor. In addition, at least temporarily energy for supplying the secondary unit and terminal devices connectable thereto is transmitted in contactless manner across the transformer coupling distance from the primary unit to the secondary unit. The energy transmission from the primary unit to the secondary unit is at least temporarily interrupted. This energy transmission interruption is called the energy transmission interval. The secondary unit detects such an energy transmission interval and during the same transmits data across the transformer coupling distance to the primary unit.

In a modified version of the inventive method no signals are transmitted from the secondary unit to the primary unit in the energy transmission intervals. However, data are transmitted from the primary unit to the secondary unit. The data can, e.g., be imaged by varying the length of the energy transmission interval. Another possibility is to express the data by different spacings of several energy transmission intervals or to use both data encoding types.

In an embodiment of the two inventive methods, there is both a transmission of signals in the energy transmission intervals from the secondary to the primary unit and a transmission of data from the primary unit to the secondary unit. Thus, in this variant use is made of a single bidirectional channel both for the data and the energy transmission.

Data transmitted from the primary unit to the secondary unit can, e.g., be instructions for switching of actuators connected to the secondary unit, initialization commands or configuration data for the secondary unit or for connected equipment such as sensors or actuators. Data transmitted from the secondary to the primary unit, can, e.g., be switching states or other state variables of the connected terminal devices.

It is also possible to transmit data from the primary unit to the secondary unit in the energy transmission intervals. However, for this purpose a corresponding control can be provided, so that data from the primary unit are not superimposed by data from the secondary unit.

An inventive method can be used for transmitting energy and data between a fixed primary unit and a movable secondary unit. This can, e.g., be the case with pressure rollers, where the secondary unit is positioned in or close to the spindle. Another example is a high-bay facility in which the goods in the facility are automatically loaded into or unloaded from the shelves by loading and unloading devices. The secondary unit can, e.g., be provided on a loading and unloading device and the primary unit can be at a fixed, predefined location to which the loading and unloading device returns in the rest state.

In order to transmit energy from the primary to the secondary unit, it is preferable for the primary inductor to be excited with an alternating current for energy transmission. The primary inductor can itself be part of the resonant circuit or can be excited by the same. The control of the resonant circuit is preferably regulated by means of a current intensity measurement, a driver and a transistor bridge. The current intensity measurement can, e.g., take place by means of a transformer, whose measurement signal is proportional to the current intensity. In order to maintain the oscillations in the coil, the measured signals from the transformer are amplified with a phase correction and forwarded to the driver. The driver controls the transistor bridge or its driving circuit in such a way that the transistor bridge always switches close to the zero passage of the resonant circuit current and consequently the resonant circuit is additionally excited. This avoids switching losses and so-to-speak there is a square-wave voltage at the resonant circuit. In the driver there can also be a monitoring of the instantaneous resonant circuit current, so as to discontinue excitation in the case of excessive currents.

In order to ensure as rapidly as possible that no further energy is transmitted across the transformer coupling distance on energy transmission interruption, it is preferable if the residual energy is reduced in accelerated manner in the primary inductor. This can, e.g., take place via the driver, which then in phase-inverted manner supplies the primary inductor or resonant circuit with current, so that the oscillation is damped. Alternatively this can take place by a series-connected transistor section, e.g., of FETs and/or resistors.

With conventional inductor coupling distances the secondary inductor is operated tuned to the primary inductor or its oscillation frequency. However, this requires corresponding tuning between the two inductors. A problem arises also as a result of drift of the natural frequencies, e.g., due to ageing or temperature changes. It is therefore preferable to operate the secondary inductor in untuned manner when using the inventive transformer coupling distance. Thus, no effort is made to tune the same to the resonant frequency of the primary inductor or the resonant circuit in the primary unit.

One possibility for detecting energy transmission intervals through the secondary unit is to monitor the voltage across the secondary inductor. If this voltage drops, it is concluded that an energy transmission interval is starting.

The data transmission from the secondary unit to the primary unit in an energy transmission interval can in principle take place in random manner. However, it is particularly simple if current is supplied to the secondary inductor for data transmission and the current flow through the secondary inductor is then and in particular abruptly stopped. As a result a pulse is triggered and is transmitted to the primary inductor across the transformer coupling distance and can be detected in the primary unit as a voltage pulse.

Thus, it is, e.g., possible for transmitting a datum with the value 1 in the energy transmission interval to transmit a voltage or current pulse to the primary unit or to excite the same there and to generate no voltage or current pulse for transmitting a datum with the value 0 in the energy transmission interval. However, other encoding possibilities are conceivable. Thus, also with a pulse it is possible to transmit information symbols, so that transmission of several bits can take place with one pulse. This requires corresponding modulation and demodulation as well as evaluation devices both on the primary and on the secondary unit.

The data transmitted from the secondary unit to the primary unit can, e.g., be constituted by information concerning measurement signals of connected sensors. It is also possible to transmit information regarding the present switching states of connected actuators. It has proved advantageous if the data undergo source or channel encoding before or during transmission in order to reduce the susceptibility to transmission errors. It is also possible to provide a checksum to permit the detection of transmission errors.

BRIEF DESCRIPTION OF THE DRAWINGS

The invention is described in greater detail hereinafter relative to embodiments and diagrammatic drawings.

DETAILED DESCRIPTION OF THE INVENTION

Figure 1:
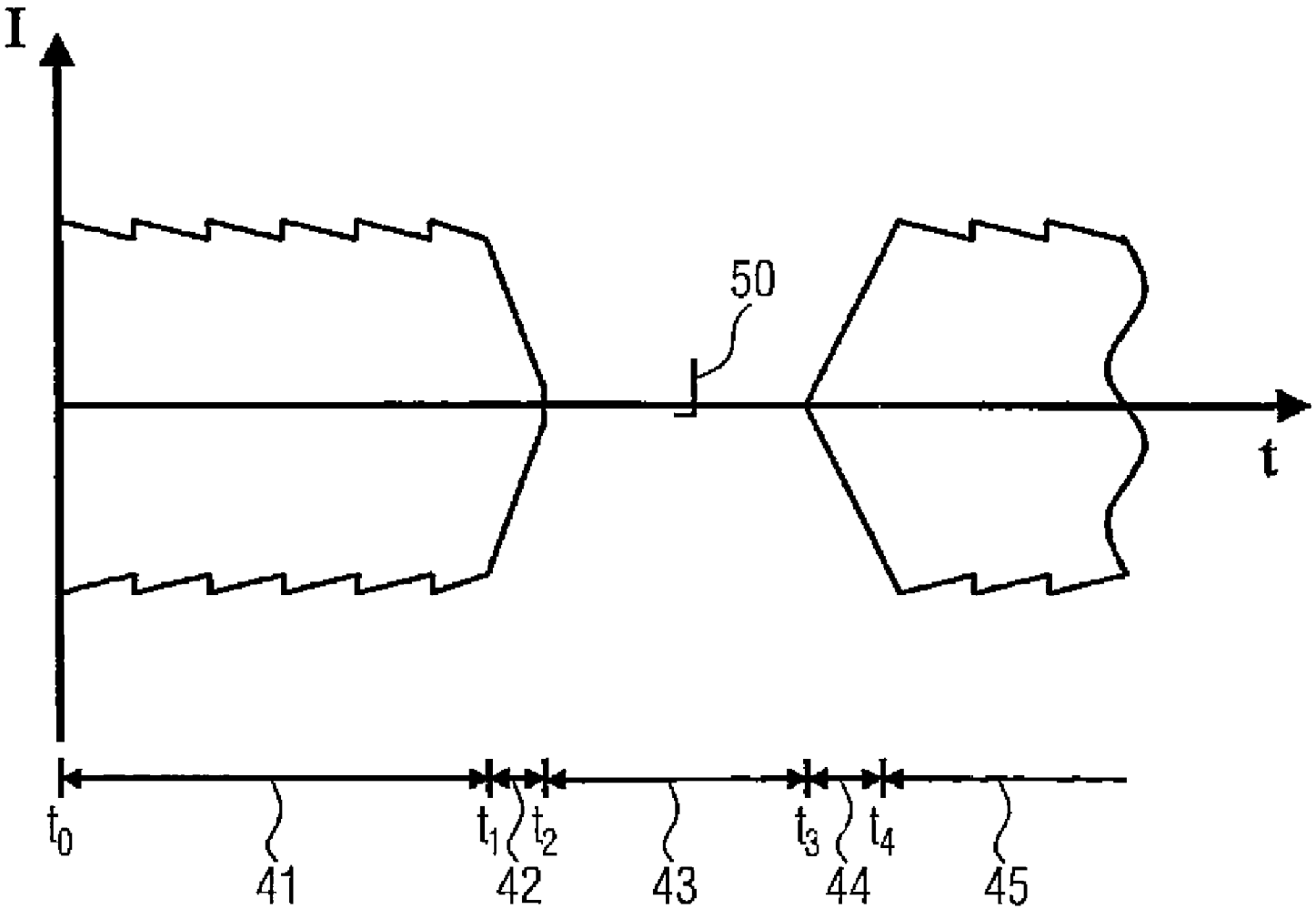
FIG. 1 depicts a diagrammatic chart of the current flow through the primary inductor.
Figure 2:
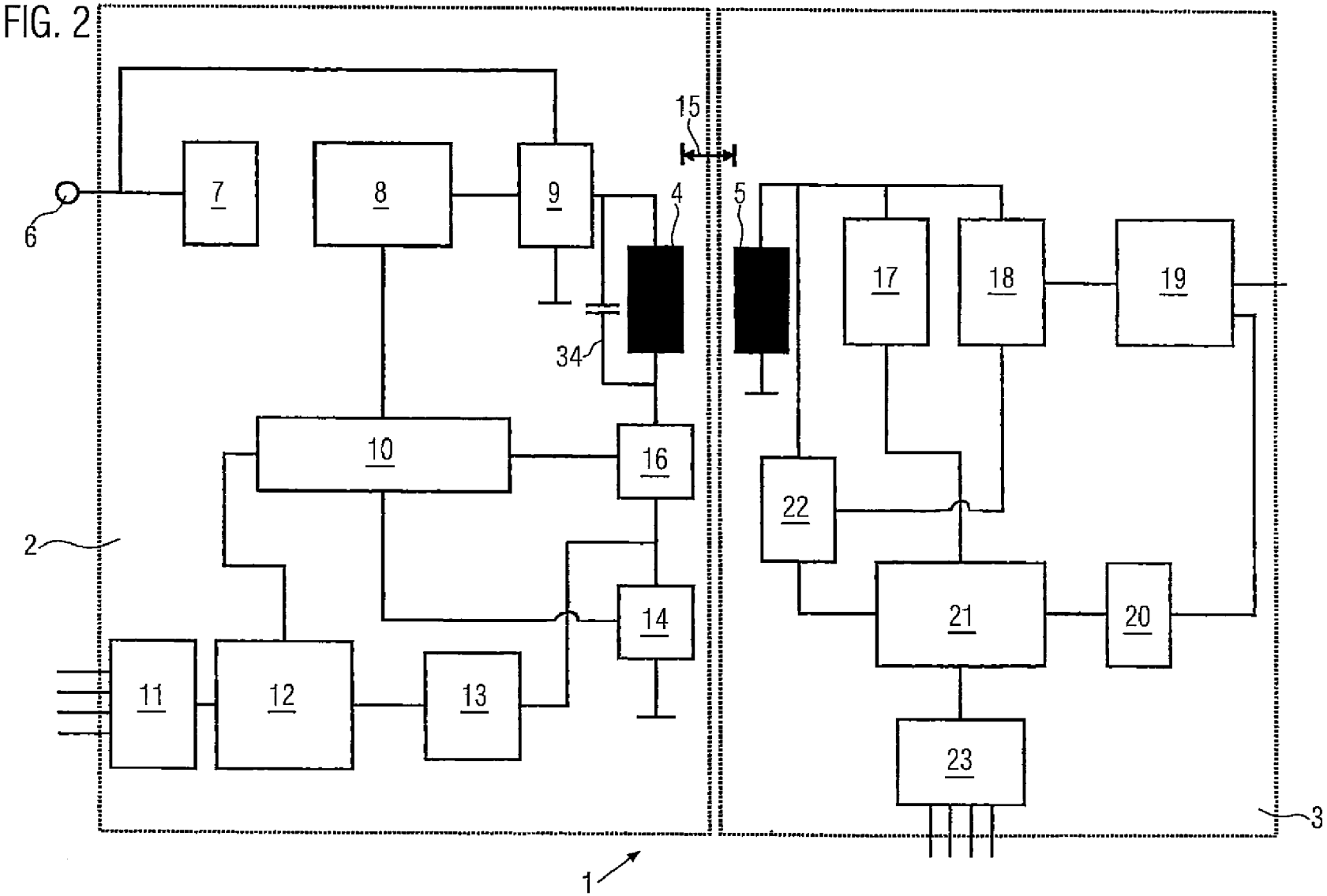
FIG. 2 depicts a diagrammatic chart of an embodiment of the inventive device.

In FIG. 1, taken in conjunction with FIG. 2, the current is plotted over time in the primary inductor 4 of the primary unit 2. Up to time $t_1$ the primary inductor 4 or the resonant circuit is excited with current by the control of the primary unit 2, so that it is made to oscillate. Thus, as from time to and also before this and up to time $t_1$ in a first energy transmission phase 41 energy is transmitted to the secondary inductor 3. The residual ripple of the current is caused by the control in the primary inductor 4. At time $t_1$ excitation of the resonant circuit or the primary inductor 4 is ended. Then between times $t_1$ and $t_2$ the energy is decreased in accelerated manner from the primary inductor 4 or the resonant circuit. This time is also referred to as the decay time 42. If there is no need for a possibility of data transmission from primary unit 2 to secondary unit 3, the energy transmission intervals 43 are introduced in periodic spacings.

The start of the energy transmitting interval 43 extending from time $t_2$ to $t_4$ is detected by the secondary unit 3. The secondary unit 3 then emits a pulse 50 by means of its secondary inductor 5 across the transformer coupling distance to the primary inductor 4 and therefore the primary unit 2.

At time $t_4$ the primary unit 2 recommences the excitation of the oscillation in the primary inductor 4 and at time $t_5$ again reaches the optimum working value. The period between $t_4$ and $t_5$ is also called the switch-on delay 44, which is followed by a new, second energy transmission phase 45. In order to also transmit data from the primary unit 2 to the secondary unit 3, it is possible to use the length of the energy transmission interval 43 for data transmission or encoding. Another or an additional possibility is to use the length of an energy transmission phase 41, 45 for transmitting the data. An energy transmission phase 41, 45 can e.g. be 4 ms and the decay time can be 20 to 30 μs. So as not to interrupt energy transmission for too long, an energy transmission interval 43 then lasts, e.g., roughly 100 to 150 μs.

Hereinafter and with reference to FIG. 2, the fundamental functionality and operation of an inventive device 1 are described.

The inventive device 1 is subdivided into a primary unit 2 and a secondary unit 3, which can also be looked upon as the primary and secondary sides of device 1. The central elements for implementing the inventive method are the primary inductor 4, which is formed by a first coil, and the secondary inductor 5, which in formed by a secondary coil. The two coils 4 and 5 are preferably positioned coaxially. The distance 15 between the two coils 4, 5 is roughly 2.5 mm and should be max. 5 mm. This distance between the two coils 4, 5 is called the transformer coupling distance.

Hereinafter a description is given of the control and operation of the coil 4 for transmitting energy to the secondary unit 3. The primary unit 2 is supplied with energy via an energy source 6, which is connected both to the general supply for the devices of the primary unit and also to a transistor bridge 9. The transistor bridge 9 can be formed from FETs. In the embodiment shown a parallel resonant circuit is formed by the coil 4 and a capacitor 34 connected in parallel thereto. However, it is also possible to use some other resonant circuit, e.g., a serial resonant circuit, for implementing the inventive method.

A control loop for controlling the oscillation of the resonant circuit is built up via the transistor bridge 9, the resonant circuit with the coil 4 and the capacitor 34, a current and voltage sensor 16, a control device 10 and a bridge driver 9. The current and voltage sensor 16 measures the current which flows through the coil 4 and forwards a measurement signal to the control device 10. This signal can be amplified with a phase correction. The current measurement in the current and voltage sensor 16 can, e.g., be performed by a transformer, whose measurement signal is proportional to the current intensity.

The control device 10, which can also be referred to as the control logic for the bridge driver 8, switches the transistor bridge 9 with the aid of its driver 8 in such a way that the resonant circuit is made to resonate. This, e.g., takes place by a switching at the time of the zero passage of the resonant circuit current. The current measured by the current and voltage sensor 16 is also used for current regulation in the coil 4 in order to ensure that the resonant circuit current does not become inadmissibly high. The control is implemented by the control device 10 in such a way that in the case of an excessive current through the coil 4 there is no further excitation of the resonant circuit.

The control device 10 also initiates an energy transmission interval 43 and indicates to the driver 8 that the oscillation should not be maintained or supported. It also activates a decay accelerator 14, which can, e.g., be formed by transistors and resistors and ensures that there is a reduction with a maximum speed of residual energy in the coil 4.

In an energy transmission interval 43 the coil 5 excites a data pulse 50 in the coil 4, as described in connection with FIG. 1. The results of a continuous voltage monitoring of the coil 4 are forwarded to a pulse processor 13. Here by means of the voltage level received decoding takes place as to which data and information are transmitted by the secondary unit 3. The data are forwarded to a central evaluation unit 12 for further processing. The evaluation unit 12 can, e.g., be implemented by a microprocessor or by a programmable logic, such as a FPGA. The evaluation unit 12 processes the results and outputs the same via corresponding outputs 11, e.g., on a memory-programmable control, a relay or a data bus. The evaluation unit 12 can also control the control device 10 with instructions. It is, e.g., possible to expressly request data from the secondary unit 3 in which the evaluation unit 12 instructs the control device 10 to introduce an energy transmission interval 43 for transmitting data from the secondary unit 3.

In the secondary unit 3 an a.c. voltage is excited in the coil 5 across the inductive coupling distance through the coil 4. The coil 5 is connected to a general supply device 18 which, for transmitted energy storage, e.g., has a capacitor which is charged by means of a rectifier. The rectified voltage is highly spacing-dependent and in the case of a very small spacing or direct contact of the coils 4, 5 can amount to over 100 Volts. Thus, to reduce power losses a switching controller is provided. The energy stored and processed in the general supply device 18 is made available across a switching power supply 19 to the connected terminal devices or terminals, e.g., actuators or sensors.

Typically a few watts can be transmitted across the transformer coupling distance. The switching power supply 19, e.g., supplies a voltage of approximately 12 V to the terminals, which consume approximately 160 to 170 mA.

In addition, there is also an interval detection 17 directly at the coil 5. The interval detection measures the voltage transmitted in the coil 5 and informs a central processing device 21 as soon as the voltage drops below a threshold. The central processing device 21 can, e.g., be in the form of a microcontroller or a programmable logic, such as a FPGA. If the central processing device 21 receives from the interval detector 17 the information that at present the voltage is below a threshold, it interprets it as an energy transmission interval 43. The central processing device 21 then transfers corresponding instructions to a pulse generator 22 for transmitting specific pulse shapes across the coil 5 by mean of the inductive coupling distance to the coil 4 of the primary unit 2. The energy for the transmission pulse generation also emanates from the general energy supply 18.

The central processing device 21 also receives information via inputs 23, which are connected to sensor or actuators. By means of not shown outputs, the central processing device 21 can also transmit instructions to actuators or sensors.

There is finally an undervoltage detector 20, which monitors the voltage at the switching power supply 19. If this voltage drops below a specific value, e.g., below 12 V, the data which are supplied via the inputs 23 by the sensors are no longer reliable. The undervoltage detector 20 informs the central processing device 21 thereof, so that the unreliable data are not transmitted to the primary unit 2.

During energy transmission the voltage at the primary coil 4 can be approximately 100 to 200 V and a data pulse, e.g., has roughly 100 to 200 mV.

Figure 3:
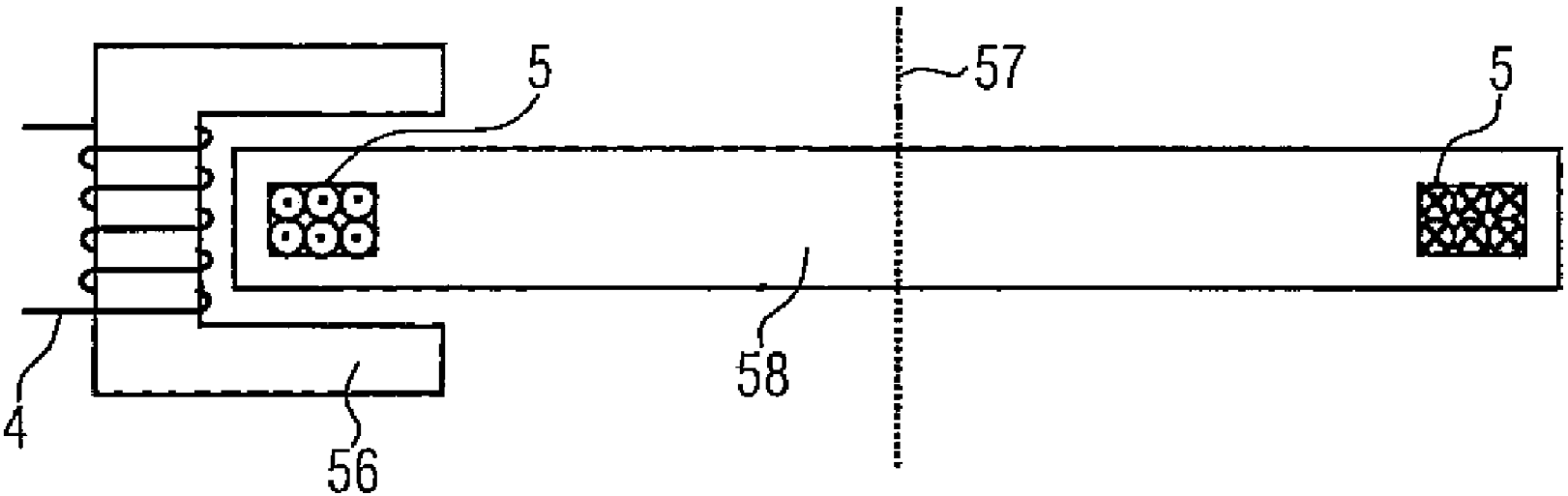
FIG. 3 depicts a diagrammatic chart of an illustrative arrangement of primary and secondary inductors.

FIG. 3 shows a possibility for the positioning of the primary coil 4 and the secondary coil 5. The primary coil 4 has a U-shaped core 56. The secondary coil 5 is located on the outer circumferential area of a disk 58 mounted in rotary manner about its centre axis 57. The disk 58 can, e.g., be a rotary table of a filling installation. If the disk 58 rotates, at least one area of the secondary coil 5 is in transformer coupling with the primary coil 4. Preferably when positioning the two coils 4, 5 it is preferable for most of the field lines of primary coil 4 to pass through at least partial areas of the secondary coil 5.

The inventive device and method consequently provide a contactless, effective and interference-unprone energy and data transmission across a single interface.

The invention claimed is:

1. Device for contactless energy and data transmission,
having a primary unit provided with a primary inductor,
having a secondary unit provided with a secondary inductor, and which is set up for at least one of the connection, the supplying, and the controlling of at least one terminal device,
the primary unit and the secondary unit at least temporarily being so positioned relative to one another that a transformer coupling distance is formed between the primary inductor and the secondary inductor,
wherein the primary unit is set up for the contactless transmission of energy to the secondary unit across the transformer coupling distance and
wherein the secondary unit is set up for supplying the terminal devices by means of the energy received across the transformer coupling distance,
wherein the primary unit has means for interrupting the energy transmission across the transformer coupling distance in energy transmission intervals,
wherein the secondary unit has means for detecting the energy transmission intervals,
wherein the primary unit has means for transmitting data through the variation of at least one of the length of the energy transmission intervals and the length of the energy transmission phases to the secondary unit and
wherein the secondary unit has means for transmitting data to the primary unit across the transformer coupling distance in the energy transmission intervals.

2. Device according to claim 1, wherein the primary unit has a transistor section for the accelerated reduction of a residual energy in the primary inductor on interrupting the energy transmission.

3. Device according to claim 1, wherein the primary unit has means for monitoring a voltage across the primary inductor.

4. Device according to claim 1, wherein the primary unit has means for measuring a current in the primary inductor.

5. Device according to claim 1, wherein the secondary unit has means for measuring a voltage across the secondary inductor.

6. Device according to claim 1, wherein the secondary unit has a storage capacity for buffering a supply of the terminal devices.

7. Device according to claim 1, wherein the primary inductor is implemented as part of a resonant circuit.

8. Method for contactless energy and data transmission between a primary unit and a secondary unit, which is set up for at least one of the connecting, the supplying, and the controlling of at least one terminal device,
where the primary unit has a primary inductor and
where the secondary unit has a secondary inductor,
in which the primary unit is at least temporarily so positioned relative to the secondary unit that between the primary inductor and the secondary inductor a transformer coupling distance is formed,
in which at last temporarily energy is transmitted in contactless manner across the transformer coupling distance from the primary unit to the secondary unit for supplying the secondary unit and the connected terminal devices,
wherein the transmission of energy from the primary unit to the secondary unit is interrupted in energy transmission intervals,
wherein the energy transmission intervals are detected by the secondary unit, wherein, during the energy transmission intervals, the secondary unit transmits data across the transformer coupling distance to the primary unit and
wherein by means of at least one of the length of the energy transmission intervals and the distance between two energy transmission intervals, information is transmitted from the primary unit to the secondary unit.

9. Method according to claim 8, wherein the transformer coupling distance is operated outside of resonances of the secondary inductor.

10. Method according to claim 8, wherein a residual energy in the primary inductor is reduced in accelerated manner on the energy transmission interruption.

11. Method according to claim 8, wherein the primary inductor is excited with alternating current for energy transmission and wherein the alternating current is regulated by means of a current intensity measurement, a drive and a transistor bridge.

12. Method according to claim 8, wherein for detecting the energy transmission intervals through the secondary unit, evaluation takes place of a voltage across the secondary inductor.

13. Method according to claim 8, wherein the secondary inductor is supplied with current for transmitting data and the current flow through the secondary inductor is then stopped.

14. Method according to claim 13, wherein the secondary inductor is supplied with current for transmitting data and the current flow through the secondary inductor is then abruptly stopped.

15. Method according to claim 8, wherein for transmitting a datum with the value "1" in an energy transmission interval at least one of a voltage and a current pulse is transmitted and wherein for transmitting a data with the value "0" in an energy transmission interval no voltage and current pulse is transmitted.

16. Method according to claim 8, wherein by means of the data, information on terminal devices is transmitted.

17. Method according to claim 16, wherein by means of coded data, information on terminal devices is transmitted.

* * * * *